US005899246A

United States Patent [19]

Cummins et al.

[11] Patent Number: 5,899,246

[45] Date of Patent: May 4, 1999

[54] VENTED SELF-SUPPORTING FILLING DEVICE

[76] Inventors: Lane A. Cummins, 11300 Titian Dr., Austin, Tex. 78758-4136; Donnie J. Strybos, 1012 Acanthus St., Pflugerville, Tex. 78660

[21] Appl. No.: 08/873,938

[22] Filed: Jun. 12, 1997

Related U.S. Application Data

[63] Continuation-in-part of application No. 08/695,226, Aug. 6, 1996, abandoned.

[51] Int. Cl.[6] ..... B67C 11/00

[52] U.S. Cl. ..... 141/297; 141/331; 141/332; 141/340; D7/700; D23/200

[58] Field of Search ..... 141/297–300, 141/331, 332, 337–342; D7/700; D23/200; D15/150

[56] References Cited

U.S. PATENT DOCUMENTS

| | | | |
|---|---|---|---|
| 91,899 | 6/1869 | Beaumont | 141/297 |
| 92,791 | 7/1869 | Burwell | 141/339 |
| 300,691 | 6/1884 | Brown | 141/339 |
| 1,368,640 | 2/1921 | Melchior | 141/340 |
| 1,420,039 | 6/1922 | Horstkotte | 141/338 |
| 1,487,824 | 3/1924 | Vincent | 141/297 |
| 1,662,147 | 3/1928 | Farden | 141/339 |
| 2,250,910 | 7/1941 | Hiett | 141/339 |
| 2,315,473 | 3/1943 | Wolcott | 141/340 |
| 2,503,525 | 4/1950 | Sutherland | 141/340 |
| 2,517,759 | 8/1950 | Bentzen | 141/340 |
| 2,767,744 | 10/1956 | Beerman | 141/332 |
| 2,902,062 | 9/1959 | Smekal | 141/299 |
| 4,804,026 | 2/1989 | Bailey | 141/340 |
| 5,269,354 | 12/1993 | Koberg | 141/332 |
| 5,291,921 | 3/1994 | Devine | 141/332 |
| 5,385,180 | 1/1995 | Wittman | 141/340 |
| 5,607,004 | 3/1997 | Cope | 141/340 |

FOREIGN PATENT DOCUMENTS

| | | | |
|---|---|---|---|
| 415423 | 9/1910 | France | 141/299 |
| 457950 | 9/1913 | France | 141/299 |
| 1087062 | 2/1955 | France | 141/331 |
| 707210 | 5/1941 | Germany | 141/300 |
| 8477 | of 1912 | United Kingdom | 141/299 |

*Primary Examiner*—J. Casimer Jacyna

[57] ABSTRACT

A new Vented Self-Supporting Filling Device for providing a filling device that can be stably positioned within an opening of a receiving container. The inventive device includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

26 Claims, 5 Drawing Sheets

VENTED SELF-SUPPORTING FILLING DEVICE

CROSS-REFERENCE TO RELATED APPLICATION

This application is a continuation-in-part of our prior utility patent application Ser. No. 08/695,226, filed Aug. 06, 1996 now abandoned.

BACKGROUND OF THE INVENTION

1. Field of the Invention

The present invention relates to filling devices and more particularly pertains to a new Vented Self-Supporting Filling Device for providing a filling device that can be stably positioned within an opening of a receiving container.

2. Description of the Prior Art

The use of filling devices is known in the prior art. More specifically, filling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art filling devices include U.S. Pat. No. 4,711,276; U.S. Pat. No. 5,121,779; U.S. Pat. No. 5,277,234; U.S. Pat. No. 5,472,025; U.S. Pat. No. 5,385,180; and U.S. Pat. No. 4,494,585.

While these devices fulfill their respective, particular objectives and requirements, the aforementioned patents do not disclose a new Vented Self-Supporting Filling Device. The inventive device includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

In these respects, the Vented Self-Supporting Filling Device according to the present invention substantially departs from the conventional concepts and designs of the prior art, and in so doing provides an apparatus primarily developed for the purpose of providing a filling device that can be stably positioned within an opening of a receiving container.

SUMMARY OF THE INVENTION

In view of the foregoing disadvantages inherent in the known types of filling devices now present in the prior art, the present invention provides a new Vented Self-Supporting Filling Device construction wherein the same can be utilized for providing a filling device that can be stably positioned within an opening of a receiving container.

The general purpose of the present invention, which will be described subsequently in greater detail, is to provide a new Vented Self-Supporting Filling Device apparatus and method which has many of the advantages of the filling devices mentioned heretofore and many novel features that result in a new Vented Self-Supporting Filling Device which is not anticipated, rendered obvious, suggested, or even implied by any of the prior art filling devices, either alone or in any combination thereof.

To attain this, the present invention generally comprises a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Vented Self-Supporting Filling Device apparatus and method which has many of the advantages of the filling devices mentioned heretofore and many novel features that result in a new Vented Self-Supporting Filling Device which is not anticipated, rendered obvious, suggested, or even implied by any of the prior art filling devices, either alone or in any combination thereof.

It is another object of the present invention to provide a new Vented Self-Supporting Filling Device which may be easily and efficiently manufactured and marketed.

It is a further object of the present invention to provide a new Vented Self-Supporting Filling Device which is of a durable and reliable construction.

An even further object of the present invention is to provide a new Vented Self-Supporting Filling Device which is susceptible of a low cost of manufacture with regard to both materials and labor, and which accordingly is then susceptible of low prices of sale to the consuming public, thereby making such Vented Self-Supporting Filling Device economically available to the buying public.

Still yet another object of the present invention is to provide a new Vented Self-Supporting Filling Device which provides in the apparatuses and methods of the prior art some of the advantages thereof, while simultaneously overcoming some of the disadvantages normally associated therewith.

Still another object of the present invention is to provide a new Vented Self-Supporting Filling Device for providing a filling device that can be stably positioned within an opening of a receiving container.

Yet another object of the present invention is to provide a new Vented Self-Supporting Filling Device which includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

Still yet another object of the present invention is to provide a new Vented Self-Supporting Filling Device that may be firmly positioned within an opening of a receiving container so as to maintain a generally upright orientation during use.

Even still another object of the present invention is to provide a new Vented Self-Supporting Filling Device that allows for venting of air from a receiving container during transfer of material thereto. Thus, allowing for quicker transfer of material from a pouring container to the receiving container.

Even still another object of the present invention is to provide a new Vented Self-Supporting Filling Device that can accommodate receiving containers having various sized openings.

Even still another object of the present invention is to provide a new Vented Self-Supporting Filling Device that allows a pouring container to be stably positioned therein in an inverted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
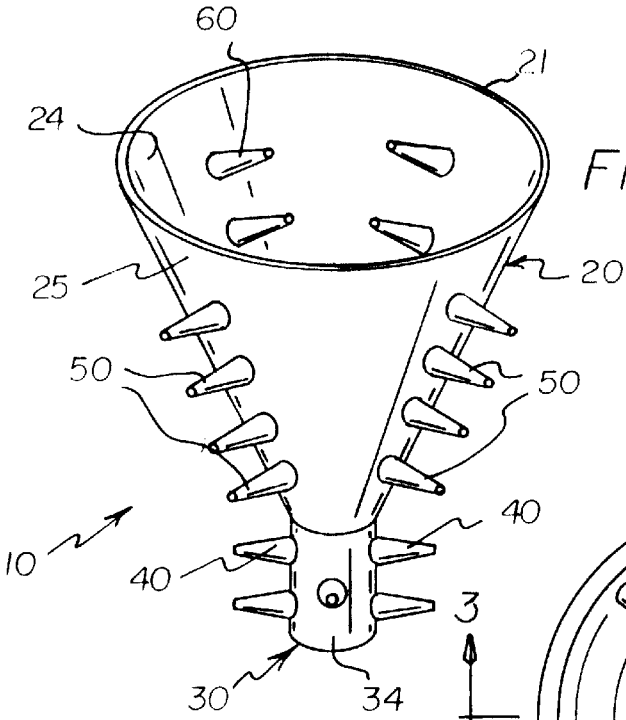
FIG. 1 is a perspective view of a new Vented Self-Supporting Filling Device according to the present invention.
Figure 2:
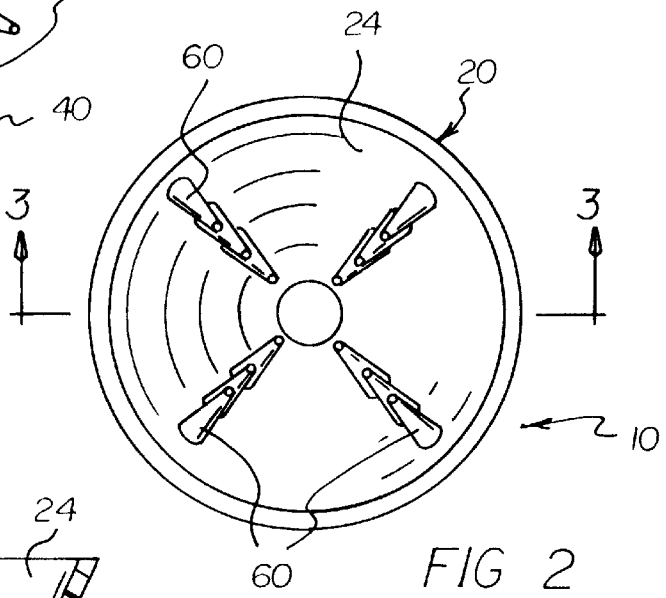
FIG. 2 is a top view thereof.
Figure 3:
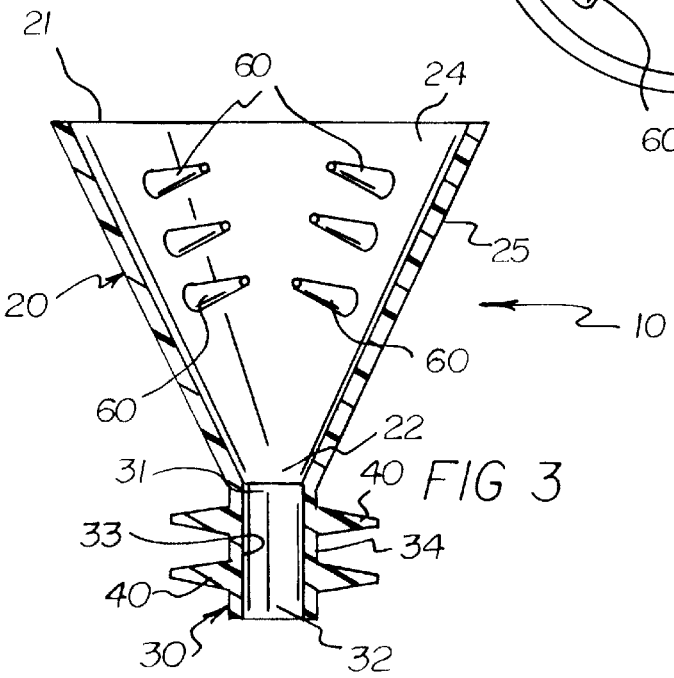
FIG. 3 is a cross sectional view taken along line 3—3 of FIG. 2.
Figure 4:
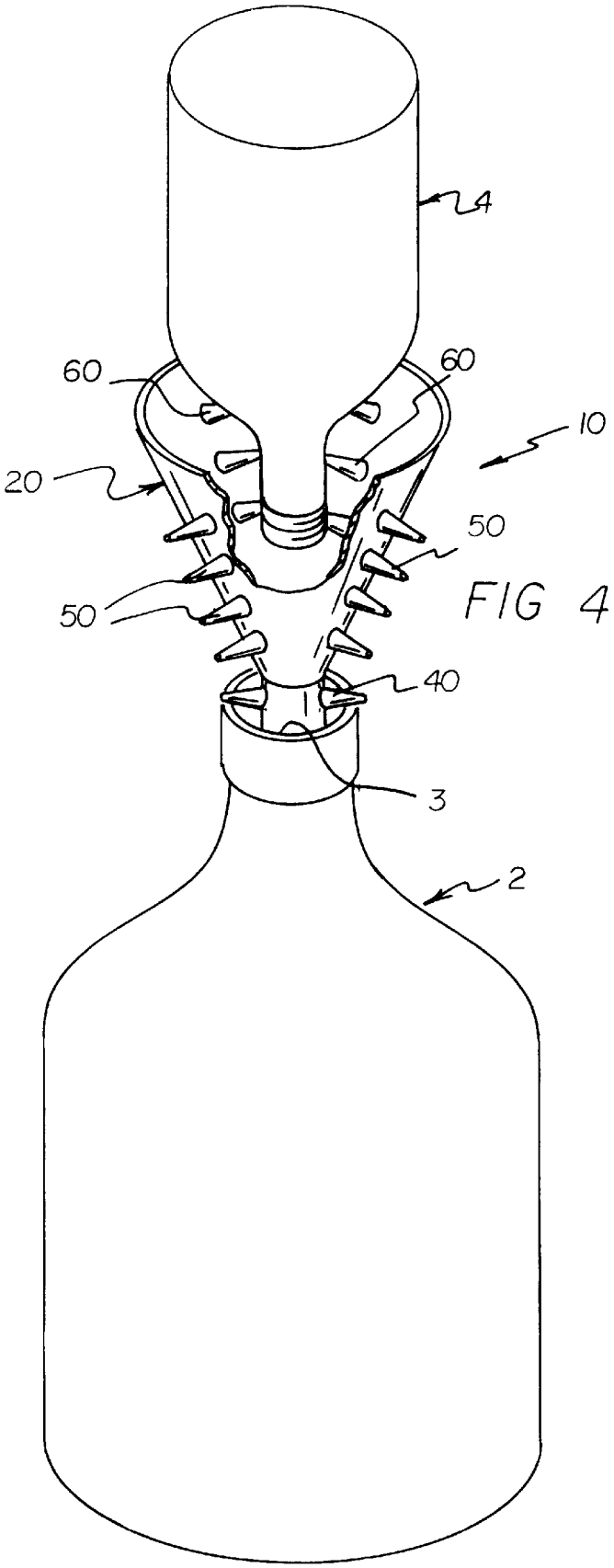
FIG. 4 is an illustration of the present invention in use.

With reference now to the drawings, and in particular to FIGS. 1 through 10 thereof, a new Vented Self-Supporting Filling Device embodying the principles and concepts of the present invention and generally designated by the reference numeral 10 will be described.

As best illustrated in FIGS. 1 through 10, the Vented Self-Supporting Filling Device 10 comprises a conical member 20 having an open top end 21 and an open bottom end 22, and a tubular member 30 integrally joined to the conical member 20. The tubular member 30 has an open upper end 31 and an open lower end 32, wherein the open upper end 31 is integrally joined to and communicates with the open bottom end 22 of the conical member 20. A plurality of outer fingers 40 outwardly project from the tubular member 30 for stably supporting the filling device 10 in a generally upright orientation when positioned within an opening 3 of a receiving container 2. In addition, a plurality of inner fingers 60 inwardly project from the conical member 20 for stably supporting a pouring container 4 when positioned within the filling device 10 in an inverted orientation.

The conical member 20 has a tapered body tapering from the open top end 21 to the open bottom end 22. The conical member 20 includes an annular rim 23 along the open top end 21 thereof. In addition, the conical member 20 has an inner surface 24 and an outer surface 25. The tubular member 30 also has an inner surface 33 and an outer surface 34.

As best illustrated in FIGS. 1 through 4, a plurality of first outer fingers 40 project outward from the outer surface 34 of the tubular member 30 wherein the first outer fingers 40 are radially spaced around the tubular member 30. Preferably, the first outer fingers 40 extend along the outer surface 34 of the tubular member 30 from substantially the open upper end 31 to the open lower end 32. Accordingly, a number of the first outer fingers 40 fit within the opening 3 of the receiving container 2 and a number of the first outer fingers 40 protrude above the opening 3. As such, the first outer fingers 40 stably retain the filling device 10 within the opening 3 in a generally upright orientation.

As best illustrated in FIGS. 1 through 4, a plurality of second outer fingers 50 project outward from the outer surface 25 of the conical member 20 wherein the second outer fingers 50 are radially spaced around the conical member 20. Preferably, a plurality of outer columns of second outer fingers 50 are spaced around the conical member 20. In addition, each of the outer columns of second outer fingers 50 extend along the outer surface 25 of the conical member 20 from substantially the open top end 21 to the open bottom end 22.

The first outer fingers 40 and the second outer fingers 50 prevent the outer surface 25 of the conical member 20 from engaging the opening 3 of the receiving container 2, thereby preventing the conical member 20 from forming an airtight seal with the receiving container 2. Thus, the first outer fingers 40 and the second outer fingers 50 create an air space between the filling device 10 and the receiving container 2, thereby allowing for quicker transfer of material from a pouring container 4 to the receiving container 2.

As best illustrated in FIGS. 1 through 4, a plurality of inner fingers 60 project inward from the inner surface 24 of the conical member 20 wherein the inner fingers 60 are radially spaced within the conical member 20. Preferably, a plurality of inner columns of inner fingers 60 are spaced within the conical member 20. In addition, each of the inner columns of inner fingers 60 extend along the inner surface 24 of the conical member 20 from substantially the open top end 21 to the open bottom end 22. As such, the inner fingers 60 effectively grip and stably support the pouring container 4 when positioned within the filling device 10 in a generally inverted orientation. In addition, when used with a pouring container having a neck, the inner fingers 60 grip the neck and stably retain the pouring container therewithin.

In a preferred embodiment, each of the first outer fingers 40, second outer fingers 50, and inner fingers 60 are generally flexible. Accordingly, each are preferably formed of a flexible rubber material. As such, a number of the first outer fingers 40 and the second outer fingers 50 bend to fit within the opening 3 of the receiving container 2. In addition, a number of the inner fingers 60 bend to conform to the profile of the pouring container 4.

In a preferred embodiment, each of the first outer fingers 40, second outer fingers 50, and inner fingers 60 are integrally formed with the conical member 20 and the tubular member 30, respectively. In an optional embodiment, however, each of the first outer fingers 40, second outer fingers 50, and inner fingers 60 are separable from the conical member 20 and the tubular member 30, respectively.

Figure 5:
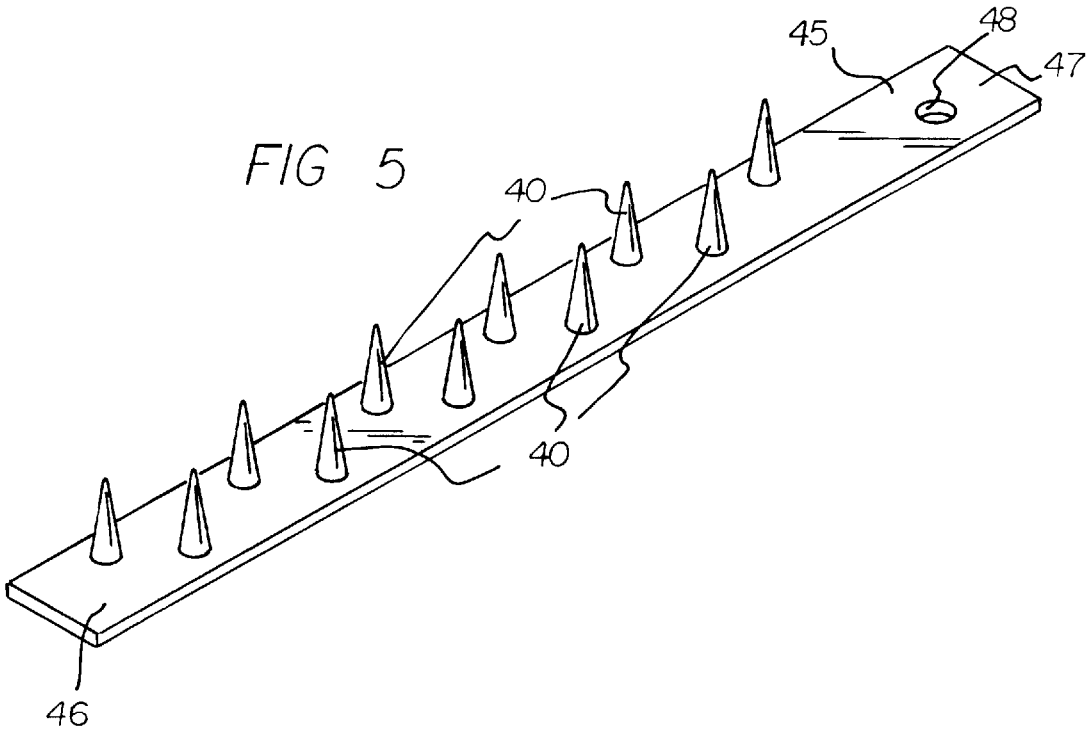
FIG. 5 is an illustration of the flexible strip and the plurality of fingers extending therefrom according to the present invention.
Figure 6:
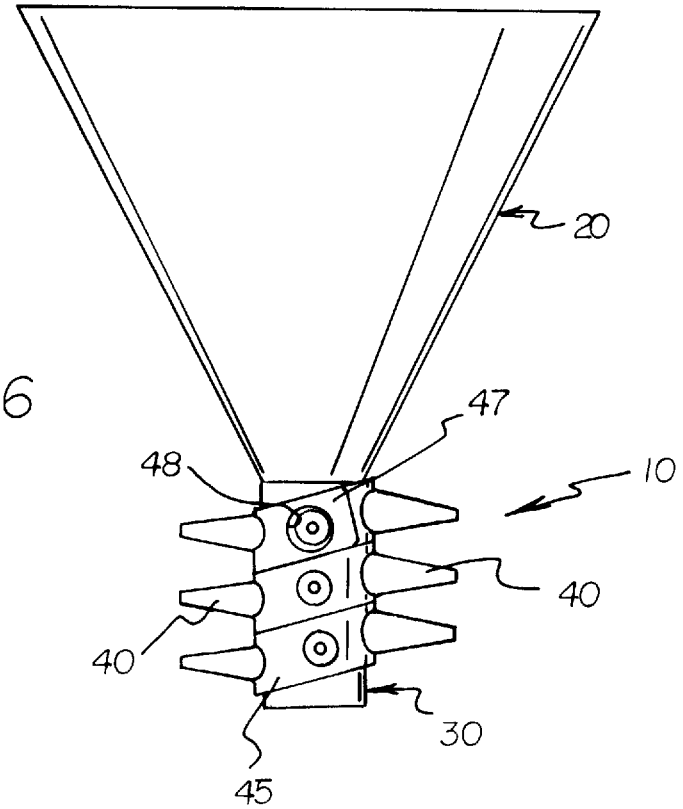
FIG. 6 is an illustration of the flexible strip wound around the filling device according to the present invention.

In an optional embodiment, best illustrated in FIGS. 5 and 6, the first outer fingers 40 are disposed on a flexible strip 45 having a first end 46 and a second end 47. Accordingly, each of the first outer fingers 40 are spaced along the flexible strip 45. In addition, the flexible strip 45 has a hole 48 therein adjacent the second end 47. As such, the flexible strip 45 is spirally wound around the outer surface 34 of the tubular member 30. One of the first outer fingers 40 is inserted through the hole 48 provided in the flexible strip 45 such that the flexible strip 45 is retained on the tubular member 30.

Figure 7:
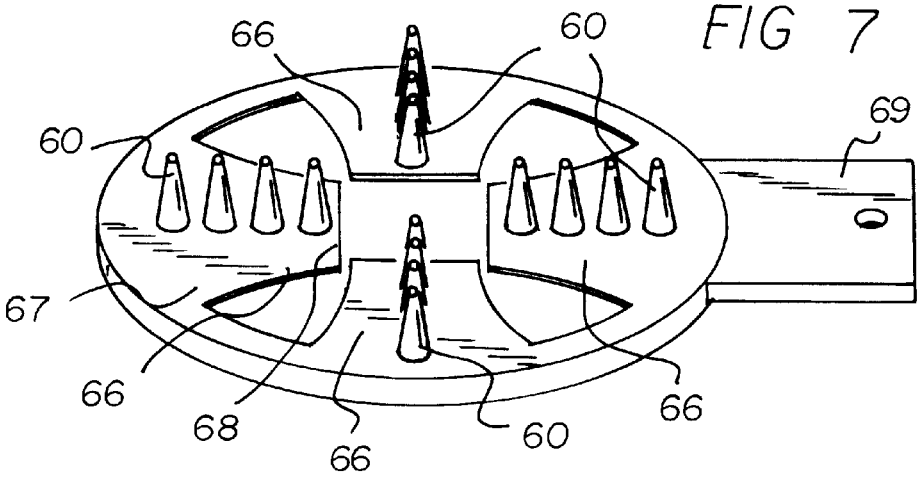
FIG. 7 is an illustration of the annular member and the plurality of fingers extending therefrom according to the present invention.
Figure 8:
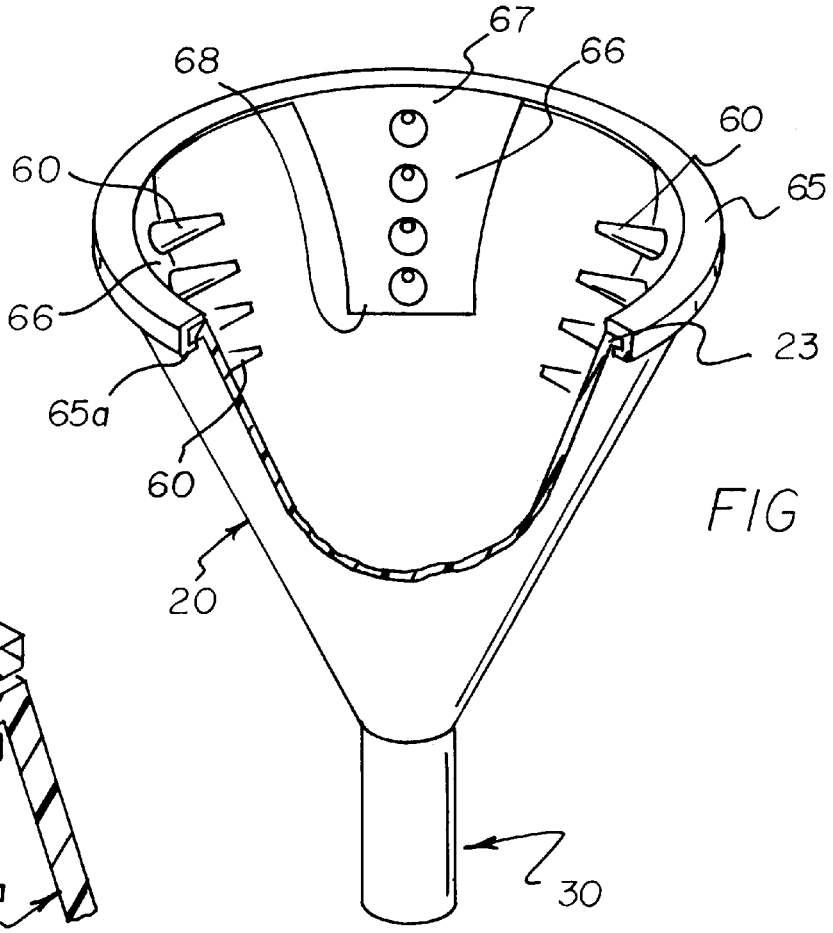
FIG. 8 is an illustration of the annular member secured to the filling device according to the present invention.
Figure 8A:
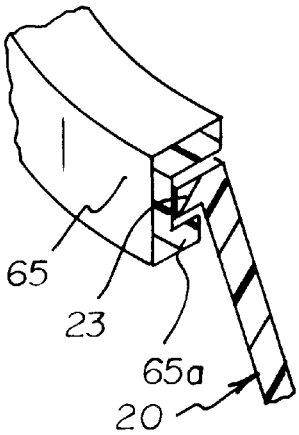
FIG. 8*a* is a detailed illustration of area 8*a* of FIG. 8.

In an optional embodiment, best illustrated in FIGS. 7 and 8, the inner fingers 60 are disposed on a plurality of flexible members 66 each attached to an annular member 65 that is securable to the conical member 20. Each of the flexible members 66 extend inward from the annular member 65 towards the center thereof. Each of the flexible members 66 have a first end 67 integrally joined to the annular member 65 and a second end 68 which is free. As such, the plurality of flexible members 66 are allowed to extend into the conical member 20 along the inner surface 24 thereof. Preferably, the plurality of flexible members 66 comprise a first pair of flexible members diametrically opposed to each other and a second pair of flexible members diametrically opposed to each other and perpendicularly oriented to the first pair of flexible members.

The annular member 65 includes an annular lip 65*a*. Accordingly, the annular lip 65*a* is adapted to receive the annular rim 23 of the conical member 20 such that when the annular member 65 is press fit onto the annular rim 23, the annular rim 23 releasably engages the annular lip 65*a*. A pull tab 69 extends beyond the periphery of the annular member 65 to facilitate removal of the annular member 65 from the annular rim 23 of the conical member 20.

Figure 9:
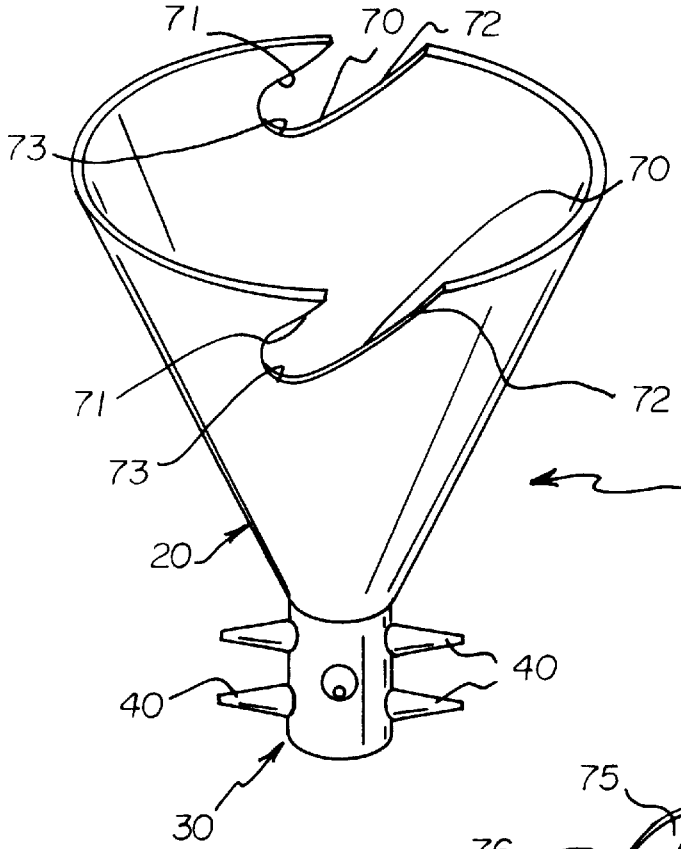
FIG. 9 is an illustration of a first embodiment of the filling device adapted for retaining a pouring container according to the present invention.
Figure 10:
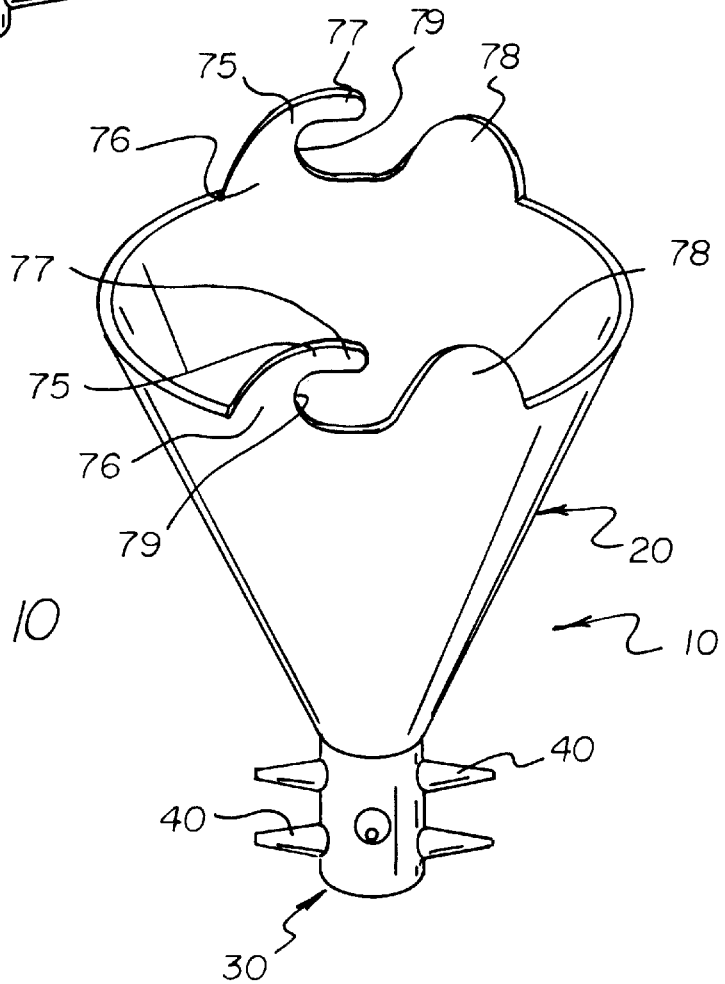
FIG. 10 is an illustration of a second embodiment of the filling device adapted for retaining a pouring container according to the present invention.

As best illustrated in FIGS. 9 and 10, the filling device 10 is adapted for receiving and retaining the pouring container 4 in a generally angled orientation. Accordingly, in a first embodiment, the conical member 20 has a pair of aligned slots 70 therein. Each of the slots 70 are arcuate-shaped and extend into contiguous communication with the annular rim 23 of the conical member 20. Accordingly, each of the slots 70 include an upper arcuate edge portion 71, a lower arcuate edge portion 72, and an end edge portion 73 interconnecting the upper arcuate edge portion 71 and the lower arcuate edge portion 72. As such, the pouring container 4 may engage the conical member 20 such that the upper arcuate edge portion 71 of each of the slots 70 extends into an opening of the pouring container 4. Accordingly, the pouring container 4 generally abuts the end edge portion 73 and the lower arcuate edge portion 72 of each of the slots 70.

In a second embodiment, a pair of aligned arms 75 protrude from the annular rim 23 of the conical member 20. In addition, a pair of support ridges 78 protrude from the annular rim 23 adjacent the pair of aligned arms 75. Each of the arms 75 have a first end 76 integral with the conical member 20 and a second end 77 extending above and along the annular rim 23 of the conical member 20 in spaced relation to the annular rim 23. Thus, each of the arms 75 form a notch 79 adapted for receiving the pouring container 4. The support ridges 78 are positioned along the annular rim 23 of the conical member 20 in spaced relation to the second end 77 of each of the arms 75. As such, the pouring container 4 may engage the conical member 20 such that each of the arms 75 extend into the opening of the pouring container 4. Accordingly, the pouring container 4 generally abuts each of the support ridges 78.

In use, the user inserts the tubular member 30 within the opening 3 of the receiving container 2. As such, the first outer fingers 40 stably retain the filling device 10 within the opening 3 in a generally upright orientation. Thus, the user may pour material through the filling device 10 without having to manually restrain the filling device 10 within the opening 3 of the container 2. In addition, the first outer fingers 40 and the second outer fingers 50 create an air space between the filling device 10 and the receiving container 2, thereby facilitating transfer of material from the pouring container 4 to the receiving container 2.

With the filling device 10 in position, the user may then position the pouring container 4 within the conical member 20 in a generally inverted orientation. As such, the inner fingers 6 effectively grip and stably support the pouring container 4. Thus, the user may allow the contents of the pouring container 4 to drain through the filling device 10 without having to manually restrain the pouring container 4 and without the risk of tipping and spilling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member integrally joined to said conical member, said tubular member having an open upper end and an open lower end, said open upper end of said tubular member integrally joined to and communicating with said open bottom end of said conical member, said tubular member having an outer surface, said tubular member being for insertion into said opening of said receiving container; and a plurality of first outer fingers for stably supporting said filling device within said opening of said receiving container, said plurality of first outer fingers projecting outwardly from said outer surface of said tubular member, wherein each of said first outer fingers is formed of a flexible material to permit bending of said finger when brought into contact with said opening of said receiving container, wherein each of said first outer fingers is discrete from the other of said fingers to permit bending of said finger independent of the other of said fingers for adapting to the size of said opening of said receiving container, and wherein each of said plurality of first outer fingers is elongate with a longitudinal axis extending substantially perpendicular to said outer surface of said tubular member.

2. The filling device of claim 1 additionally comprising a plurality of second outer fingers projecting outwardly from said outer surface of said conical member.

3. The filling device of claim 1, further comprising:

a plurality of inner fingers for stably supporting said pouring container in a generally inverted orientation within said filling device, said plurality of inner fingers projecting inwardly from said inner surface of said conical member.

4. The filling device of claim 3, wherein said plurality of inner fingers are each formed of a flexible material to permit bending of said finger when brought said pouring container is inserted in a generally inverted orientation into said open top end of said conical member for adapting to the size and shape of said pouring container.

5. The filling device of claim 1, additionally comprising a plurality of second outer fingers projecting outwardly from said outer surface of said conical member; and a plurality of inner fingers for stably supporting said pouring container in a generally inverted orientation within said filling device said plurality of inner fingers projecting inwardly from said inner surface of said conical member;

wherein said plurality of first outer fingers each have a substantially conical shape tapering in size away from said outer surface of said conical member;

wherein said plurality of first outer fingers are positioned in a substantially straight column extending substantially parallel to a longitudinal axis of said tubular member;

wherein each finger of said plurality of first outer fingers has a substantially circular cross-sectional shape for permitting deflection of said finger in any direction; and wherein each of said plurality of first outer fingers has a length dimension perpendicular to said outer surface of said tubular member and a width dimension at said outer surface of said tubular member, and wherein said length dimension is at least twice said width dimension.

6. The filling device of claim 1, wherein said plurality of fingers are positioned in a substantially straight column extending substantially parallel to a longitudinal axis of said tubular member.

7. The filling device of claim 1, wherein each finger of said plurality of fingers has a substantially circular cross-sectional shape for permitting deflection of said finger in any direction.

8. The filling device of claim 1, wherein each of said plurality of fingers has a length dimension perpendicular to said outer surface of said tubular member and a width dimension at said outer surface of said tubular member, and wherein said length dimension is at least twice said width dimension.

9. The filling device of claim 1, wherein each of said plurality of fingers has a substantially conical shape.

10. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member integrally joined to said conical member, said tubular member having an open upper end and an open lower end, said open upper end of said tubular member integrally joined to and communicating with said open bottom end of said conical member, said tubular member having an outer surface, said tubular member being for insertion into said opening of said receiving container; and a plurality of first outer fingers for stably supporting said filling device within said opening of said receiving container, said plurality of first outer fingers projecting outwardly from said outer surface of said tubular member;

wherein each of said first outer fingers is formed of a flexible material to permit bending of said finger when brought into contact with said opening of said receiving container, wherein each of said first outer fingers is discrete from the other of said fingers to permit bending of said finger independent of the other of said fingers for adapting to the size of said opening of said receiving container; and wherein said plurality of first outer fingers each have a substantially conical shape tapering in size away from said outer surface of said conical member to provide increasing resistance to deflection of said finger as said finger is bent closer to said outer surface of said conical member.

11. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member integrally joined to said conical member, said tubular member having an open upper end and an open lower end, said open upper end of said tubular member integrally joined to and communicating with said open bottom end of said conical member, said tubular member having an outer surface, said tubular member being for insertion into said opening of said receiving container; and a plurality of outer fingers projecting outwardly from said outer surface of said conical member, said plurality of outer fingers being for stably support said filling device in said opening of said receiving container;

wherein each of said outer fingers is formed of a flexible material to permit bending of said finger when brought into contact with said opening of said receiving container, wherein each of said outer fingers is discrete from the other of said fingers to permit bending of said finger independent of the other of said fingers for adapting to the size of said opening of said receiving container; and wherein each of said plurality of outer fingers is elongate with a longitudinal axis extending substantially perpendicular to said outer surface of said conical member.

12. The filling device of claim 11, further comprising:

a plurality of outer fingers projecting outwardly from said outer surface of said tubular member.

13. The filling device of claim 11, further comprising:

a plurality of inner fingers projecting inwardly from said inner surface of said conical member for stably supporting said pouring container in a generally inverted orientation in the open top end of said filling device.

14. The filling device of claim 11, further comprising:

a plurality of outer fingers projecting outwardly from said outer surface of said tubular member; and a plurality of inner fingers projecting inwardly from said inner surface of said conical member for stably supporting said pouring container in a generally inverted orientation in the open top end of said filling device;

wherein said plurality of outer fingers on said conical member are positioned in a substantially straight column extending substantially parallel to a longitudinal axis of said conical member;

wherein each finger of said plurality of outer fingers on said conical member has a substantially circular cross-sectional shape for permitting deflection of said finger in any direction;

wherein each of said plurality of outer fingers on said conical member has a length dimension perpendicular to said outer surface of said conical member and a width dimension at said outer surface of said conical member, and wherein said length dimension is at least twice said width dimension; and wherein each of said plurality of outer fingers on said conical member has a substantially conical shape.

15. The filling device of claim 11, wherein said plurality of fingers are positioned in a substantially straight column extending substantially parallel to a longitudinal axis of said conical member.

16. The filling device of claim 11, wherein each finger of said plurality of fingers has a substantially circular cross-sectional shape for permitting deflection of said finger in any direction.

17. The filling device of claim 11, wherein each of said plurality of fingers has a length dimension perpendicular to said outer surface of said conical member and a width dimension at said outer surface of said conical member, and wherein said length dimension is at least twice said width dimension.

18. The filling device of claim 11, wherein each of said plurality of fingers has a substantially conical shape.

19. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member integrally joined to said conical member, said tubular member having an open upper end and an open lower end, said open upper end of said tubular member integrally joined to and communicating with said open bottom end of said conical member, said tubular member having an outer surface, said tubular member insertable into said opening of said receiving container; and a plurality of inner fingers projecting inwardly from said inner surface of said conical member for stably supporting said pouring container in a generally inverted orientation in said open top end of said filling device;

wherein each of said inner fingers is formed of a flexible material to permit bending of said finger when brought into contact with said pouring container is inserted in a generally inverted orientation into said open top end of said conical member for adapting to the size and shape of said pouring container, wherein each of said inner fingers is discrete from the other of said fingers to permit bending of said finger independent of the other of said fingers for adapting to the size and shape of said pouring container; and wherein each of said plurality of inner fingers is elongate with a longitudinal axis extending substantially perpendicular to said inner surface of said conical member.

20. The filling device of claim 19, further comprising:

a plurality of first outer fingers projecting outwardly from said outer surface of said tubular member for stably supporting said filling device in said opening of said receiving container.

21. The filling device of claim 19, further comprising:

a plurality of outer fingers projecting outwardly from said outer surface of said conical member.

22. The filling device of claim 19, further comprising:

a plurality of first outer fingers projecting outwardly from said outer surface of said tubular member for stably supporting said filling device in said opening of said receiving container; and a plurality of second outer fingers projecting outwardly from said outer surface of said conical member;

wherein said plurality of inner fingers are positioned in a substantially straight column extending substantially parallel to a longitudinal axis of said conical member;

wherein each finger of said plurality of inner fingers has a substantially circular cross-sectional shape for permitting deflection of said finger in any direction;

wherein each of said plurality of inner fingers has a length dimension perpendicular to said inner surface of said conical member and a width dimension at said inner surface of said conical member, and wherein said length dimension is at least twice said width dimension;

wherein each of said plurality of inner fingers has a substantially conical shape.

23. The filling device of claim 19, wherein said plurality of fingers are positioned in a substantially straight column extending substantially parallel to a longitudinal axis of said conical member.

24. The filling device of claim 19, wherein each finger of said plurality of fingers has a substantially circular cross-sectional shape for permitting deflection of said finger in any direction.

25. The filling device of claim 19, wherein each of said plurality of fingers has a length dimension perpendicular to said inner surface of said conical member and a width dimension at said inner surface of said conical member, and wherein said length dimension is at least twice said width dimension.

26. The filling device of claim 19, wherein each of said plurality of fingers has a substantially conical shape.

* * * * *